US005735468A

United States Patent [19]

Casey

[11] Patent Number: 5,735,468

[45] Date of Patent: Apr. 7, 1998

[54] GAS/LIQUID MIXING APPARATUS

[76] Inventor: Alan Patrick Casey, Level 5, 10 Help Street, Chatswood NSW 2067, Australia

[21] Appl. No.: 411,824

[22] PCT Filed: Oct. 7, 1993

[86] PCT No.: PCT/AU93/00520

§ 371 Date: May 19, 1995

§ 102(e) Date: May 19, 1995

[87] PCT Pub. No.: WO94/08724

PCT Pub. Date: Apr. 28, 1994

[30] Foreign Application Priority Data

Oct. 13, 1992 [AU] Australia ..... PL5261

[51] Int. Cl.[6] ..... B05B 7/06

[52] U.S. Cl. ..... 239/425; 239/416.2

[58] Field of Search ..... 239/425, 409, 239/416.2, 417.5, 434.5, 433, 585.5; 123/452, 472, 531, 585

[56] References Cited

U.S. PATENT DOCUMENTS

| | | | |
|---|---|---|---|
| 4,006,719 | 2/1977 | Kanda | 239/403 |
| 4,434,766 | 3/1984 | Matsuoka | 123/472 |
| 4,545,354 | 10/1985 | Jaggle | 123/470 |
| 4,794,902 | 1/1989 | McKay | 123/533 |
| 4,836,453 | 6/1989 | Poehlman | 239/408 |
| 4,946,105 | 8/1990 | Pane, Jr. et al. | 239/590 |
| 5,067,657 | 11/1991 | Young et al. | 239/403 |

FOREIGN PATENT DOCUMENTS

| | | |
|---|---|---|
| 1032139 | 3/1953 | France . |
| 1310697 | 10/1962 | France . |

*Primary Examiner*—Robert J. Oberleitner
*Assistant Examiner*—C. T. Bartz
*Attorney, Agent, or Firm*—Gifford, Krass, Groh, Sprinkle, Patmore, Anderson & Citkowski, P.C.

[57] ABSTRACT

A mixing apparatus for atomizing fluid in a gas flow. The apparatus has a nozzle which fluidly communicates with a source of liquid, and a gas passage which surrounds the nozzle. The nozzle is formed such that it directs the liquid into the surrounding passage as a continuous, radial emanating sheet. The gas flowing through the passage impacts with the liquid sheet to produce a uniform cloud of atomized liquid droplets downstream of the nozzle. The apparatus may further have a reduced cross-sectional area of the passage in the vicinity of the nozzle to increase the gas velocity and enhance the atomization of the fluid. The nozzle may have a valve arrangement to selectively open and close the nozzle, and the passage may have a valve arrangement. A swirl mixing of the atomized liquid and gas may be provided downstream of the impact atomization of the fluid sheet in the passage.

14 Claims, 6 Drawing Sheets

GAS/LIQUID MIXING APPARATUS

TECHNICAL FIELD

The presentation invention relates generally to a mixing apparatus for atomising a liquid in a gas stream.

The invention has been developed primarily for use in fuel injection systems for internal combustion engines and will be described hereinafter with reference to this application in an automotive context. It will be appreciated, however, that the invention is not limited to this particular field of use.

BACKGROUND OF THE INVENTION

In various mixing devices such as carburettors, fuel injection nozzles, burner jets and the like, an atomised spray of fuel droplets is produced by directing liquid fuel into a stream of moving gas such as air.

In the past, various prior art devices have generally performed this function by directing a single jet of liquid into the gas stream. However, such devices have proven to be inefficient because of a general inability to produce a uniform spray of droplets of consistent and sufficiently small size.

Attempts have been made to overcome these deficiencies by providing a number of jets, and pumping the liquid under increased pressure. However, this has led to an increase in cost, size, weight and/or mechanical complexity of the injection system all of which are particularly undesirable in automotive applications. Moreover, the droplet size has still been too large and inconsistent to ensure completely uniform and efficient combustion, and such attempts have so far met with limited success.

The disclosure of GB A 2129492 shows a known fuel injector wherein fuel is sprayed from an injection opening. That spray is thereafter enveloped by a stream of air flowing at high speed. That mode of spraying attempts to break up the fuel as it passes through the injection opening before it is enveloped by the air. In addition the air passage for that disclosure which delivers the air terminates at a position upstream of the fuel nozzle opening so that the nozzle does not direct the fuel into the gas passage. The present invention proposes a gas liquid mixing apparatus which is in marked contrast to the arrangement of GB A 2129492 in that in the present invention the nozzle directs liquid into a gas passage. By such an arrangement a sheet of liquid is directed into a gas flow passage so that the gas flow functions to shear liquid particles away from the sheet of liquid.

It would be desirable to provide an improved mixing apparatus which overcomes or substantially alleviates at least some of the disadvantages of the prior art.

SUMMARY OF THE INVENTION

Accordingly, the invention as presently contemplated consists of a mixing apparatus comprising a nozzle in fluid communication with a source of liquid, and a passage disposed to direct a gas past the nozzle, characterised in that the nozzle is adapted to direct the liquid into the passage as a substantially continuous generally radially or conically emanating sheet such that, in use, gas flowing through the passage impacts the liquid sheet to produce a substantially uniform cloud of atomised liquid droplets downstream of the nozzle.

Preferably, the passage surrounds the nozzle and the nozzle is adapted to direct the liquid into the surrounding passage as a substantially continuous, generally conically or radially outwardly emanating sheet.

The passage is preferably annular, and substantially coaxial with the central nozzle. Preferably, the radial sheet is produced by directing the liquid through a peripheral channel extending circumferentially around the nozzle. Preferably, the gas stream is directed at an angle of between 5° and 175° relative to the axis of the passage, more preferably between 20 and 160 degrees, and most preferably between 30 and 150 degrees.

The cross-sectional flow area of the passage is prederably reduced in the vicinity of the nozzle to define a venturi region whereby the resultant increase in gas velocity around the nozzle enhances atomisation of the liquid sheet.

Preferably, the venturi region extends a sufficient distance upstream of the nozzle to minimise turbulance of the gas flowing in the passage adjacent the nozzle.

In one embodiment, the apparatus includes a liquid valve means integral with the nozzle to control the flow into the air stream.

In another embodiment, the apparatus includes a liquid valve means integral with the nozzle to control the flow of liquid into the air stream, and a gas valve means to control the flow of gas through the passage, the operation of the liquid and gas valve means being co-ordinated so that the gas valve means is always open when the liquid valve means is caused to open.

In a particular application, the liquid is a hydrocarbon fuel such as petrol, and the gas is air. In automotive applications, the fuel flow to the nozzle is preferably metered usinig onventional fuel injection technology and the air is drawn through the passage under negative pressure induced by the suction stroke of an internal combustion engine. The gas may also be a pressurised upstream of the nozzle by means of a turbocharger or supercharger if desired.

BRIEF DESCRIPTION OF THE DRAWINGS

A preferred embodiment of the invention will now be described, by way of example only, with reference to the accompanying drawings wherein.

DETAILED DESCRIPTION OF THE INVENTION

Figure 1:
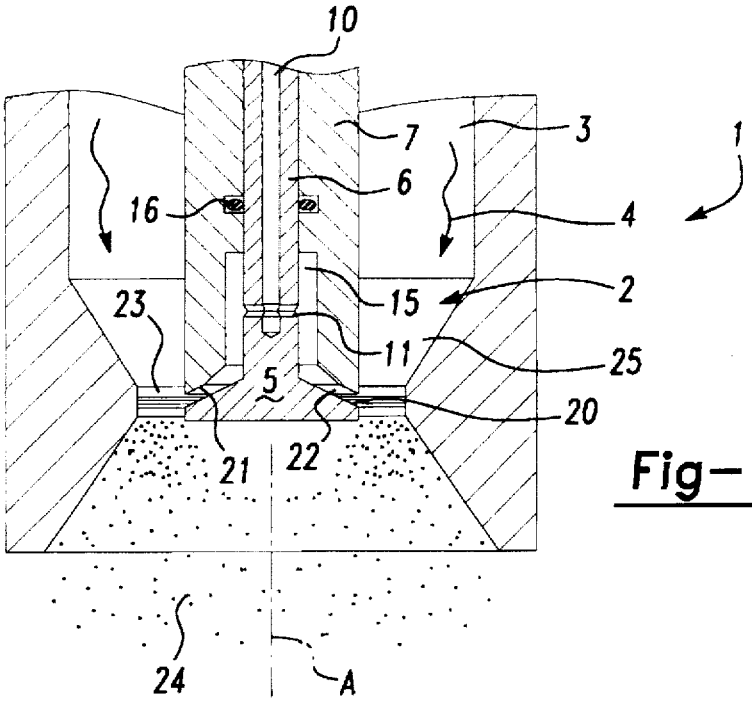
FIG. 1 is a longitudinal-sectional view of a first embodiment of the mixing apparatus according to the invention.

Referring to the FIG. 1, the invention provides a mixing apparatus 1 comprising a nozzle 2 in fluid communication with a source of liquid fuel and a surrounding substantially coaxial annular passage 3 disposed to direct a stream 4 of air or other gas around the nozzle.

The nozzle comprises a valve member 5 having a valve stem 6 supported for axial sliding movement by a surrounding valve guide 7. The valve stem 6 incorporates an axial bore 10 and radial ports 11 in fluid communication with the bore. The bore 10 and ports 11 direct liquid fuel under pressure to an annular fuel reservoir 15 defined intermediate the valve stem and an internally bored out section of the surrounding valve guide 7. An O-ring 16 prevents fuel leakage from the reservoir 15 between the valve stem 6 and valve guide 7 whilst accommodating the relative axial displacement.

In the closed position, a peripheral sealing face 20 of the valve head is urged into sealing abutment with a corresponding valve seat 21 formed in the terminal end of the guide 7 to seal the fuel reservoir 15. In the open position, the valve member is displaced downwardly (when viewing the drawings) relative to the valve guide to define a peripheral channel 22 intermediate the sealing face 20 of the valve head and the valve seat 21, thereby permitting fuel to flow from the reservoir 15.

Turning now to describe the operation of the mixing apparatus of FIG. 1 in more detail, in normal use an air stream is directed through annular passage 3 so as to flow around the nozzle 2 in a generally axial direction. The pressure gradient inducing this flow may result from the suction stroke of an internal combustion engine, a turbocharger, supercharger, a compressor, or other suitable means. This stream may be either continuous or intermittent, depending upon the particular application.

Upon actuation of the valve assembly, valve head 5 is displaced downwardly, thereby opening the channel 22 between the sealing face 20 and the valve seat 21. In this configuration, pressurised fuel from reservoir 15 is directed into the surrounding air stream as a uniform substantially continuous radial sheet 23. The gas stream impinges upon the liquid sheet, and the impact between the gas and fuel shears fuel droplets away from the sheet producing a substantially uniform cloud 24 of finely atomised liquid droplets downstream of the nozzle. The cross-sectional flow area of the passage 3 is reduced in the vicinity of the nozzle to define a venturi region 25 whereby the resultant increase in gas velocity enhances atomisation of the liquid sheet.

In the embodiment shown in FIG. 1, the air stream impinges upon the liquid sheet at an angle of around 90°. However, the liquid sheet may be directed at any angle between 5° and 175° with respect to the axis A of the passage, depending upon a number of factors such as the viscosity of the liquid, the optimum droplet size required for the particular combustion environment, the Reynolds number of the surrounding gas stream, and the like.

Figure 2:
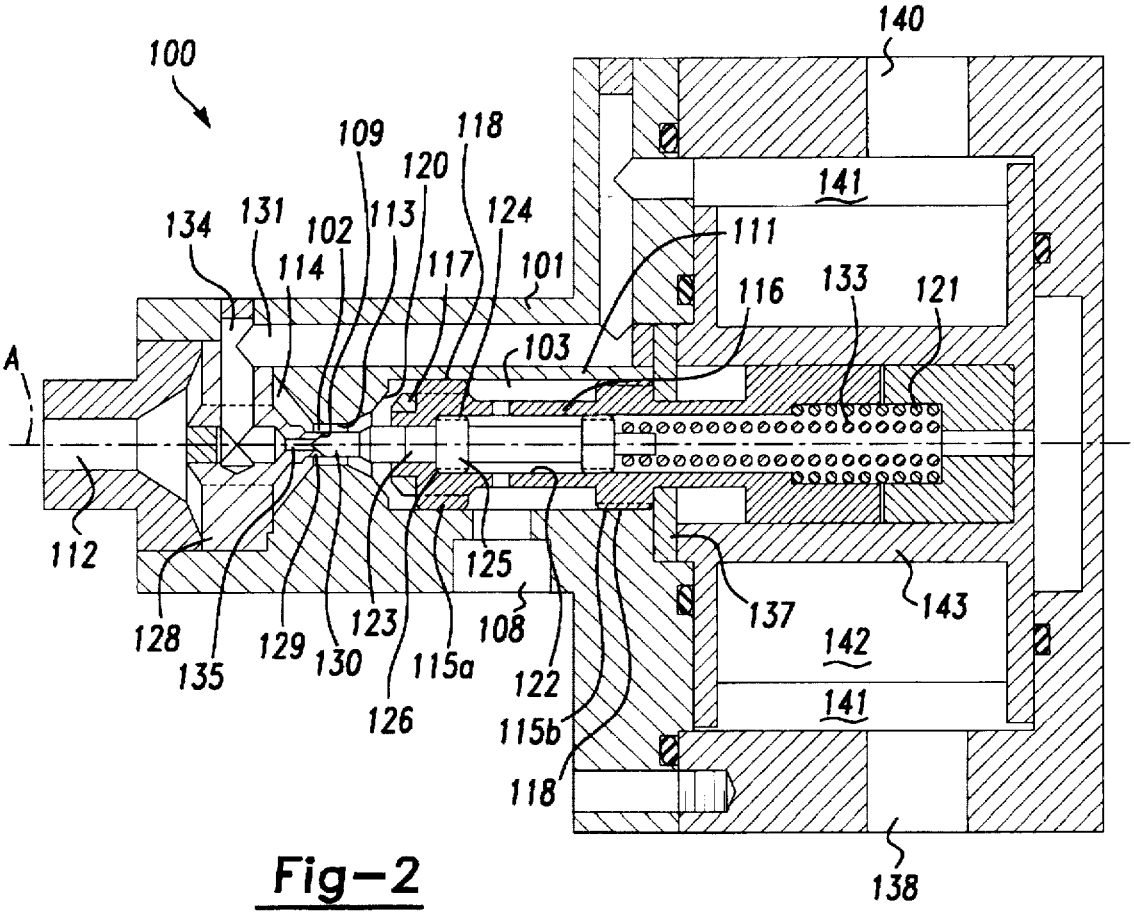
FIG. 2 is a longitudinal-sectional view of a second embodiment of the mixing apparatus according to the invention.

In a second embodiment shown in FIG. 2, there is a mixing apparatus 100 having an elongate body 101 with a longitudinally extending annular passage 103. The passage 103 communicates with a gas inlet port 108 which is to be connected to a source of gas. A fuel nozzle 102 is in fluid communication with a source of liquid fuel and is, in operation, adapted to produce a generally conically outwardly emanating sheet of fuel from the nozzle outlet 109 into the surrounding passage 103. The fuel sheet atomises by impacting with the gas flowing through the passage 103 causing fuel droplets to shear away from the sheet. The fuel and gas mixture are caused to be further mixed in a swirl mixing chamber 114 downstream of the nozzle outlet 109 before being discharged out of the apparatus 100 through an outlet 112.

The apparatus 100 is basically formed by an elongate body 101 having a central, longitudinally extending bore 111. The bore 111 communicates with the gas inlet port 108. Downstream of the gas inlet port 108, the bore 111 converges to a narrow throat area 113, diverges into the swirl mixing chamber 114 and converges again to an outlet port 112.

A first valve stem 116 with valve member 117 at one end is slidably received and guided in the first section of the bore 108 adjacent the inlet port 112. The valve member 117 is a resilient plastics material such as Vesconite™ obtainable from Accurra Engineering Pty Ltd of Short Street, Chatswood, New South Wales, Australia.

As shown in FIG. 2, the first valve stem 116 has a smaller outside diameter than the inside diameter of the bore 111 and is guided along the bore 111 by two spaced carrier parts 115*a* and 115*b*, the carrier part 115*a* being in the form of four equiangularly spaced radial projections 118 which have an effective outside diameter commensurate with the inside diameter of the bore 111. The projections 118 position the valve stem 116 centrally within the bore 111, thereby forming a portion of the annular gas flow passage 103 in the space between the inside surface of the bore 111 and the valve stem 116.

Figure 3:
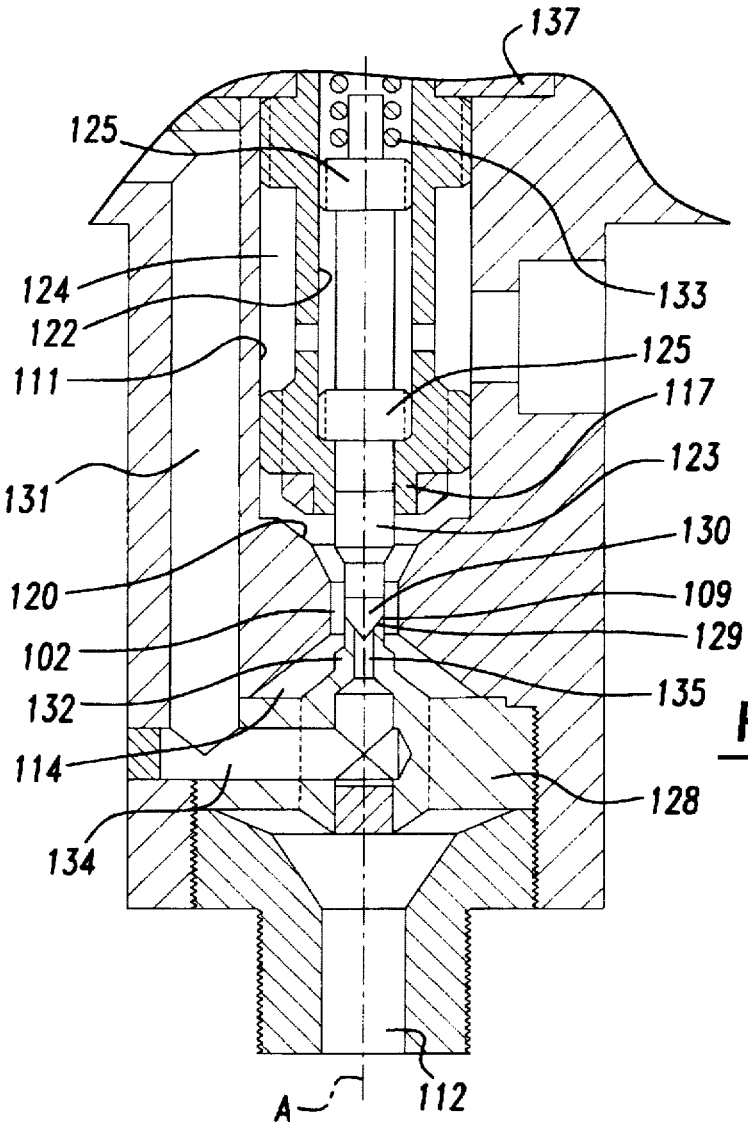
FIG. 3 is a detailed, longitudinal-sectional view of the second embodiment of the present invention.
Figure 4:
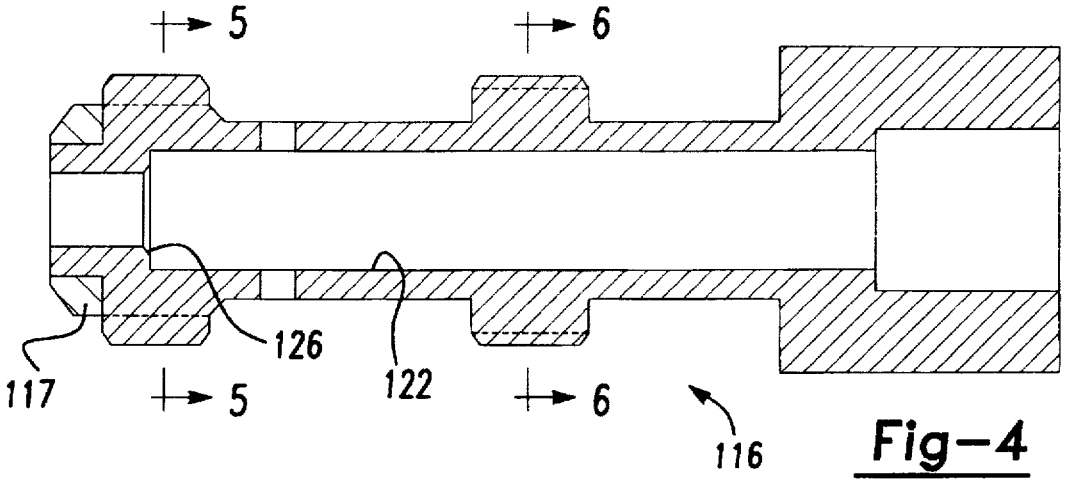
FIG. 4 is a longitudinal-sectional view of the gas valve stem of FIG. 2.
Figure 5:
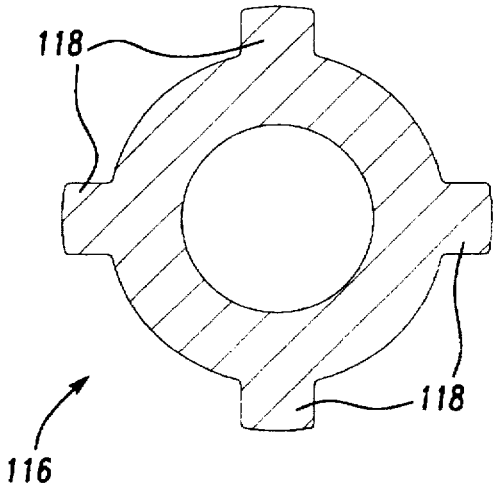
FIG. 5 is a cross-sectional view at section A—A of FIG. 4.
Figure 6:
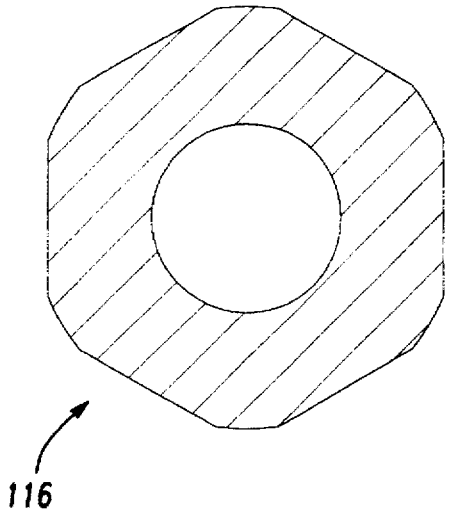
FIG. 6 is a cross-sectional view at section B—B of FIG. 4.
Figure 7:
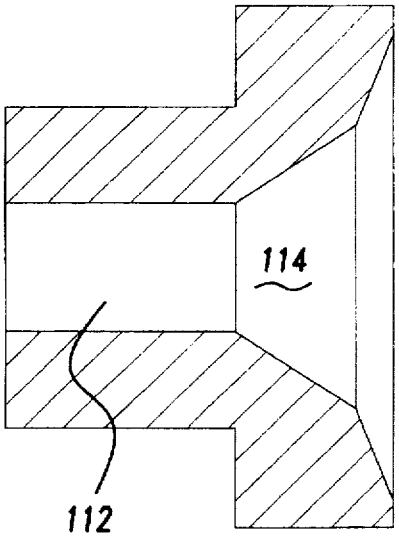
FIG. 7 is a longitudinal-sectional view of the part shown in FIG. 3 which forms the outlet.
Figure 8:
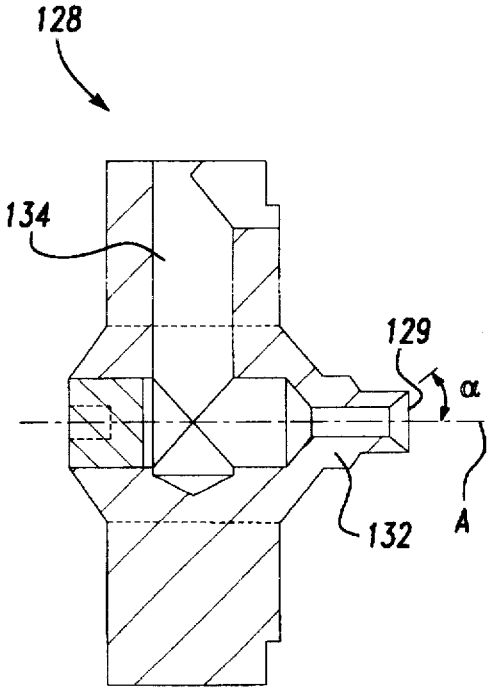
FIG. 8 is a longitudinal-sectional view of the fuel delivery part shown in FIG. 3.
Figure 9:
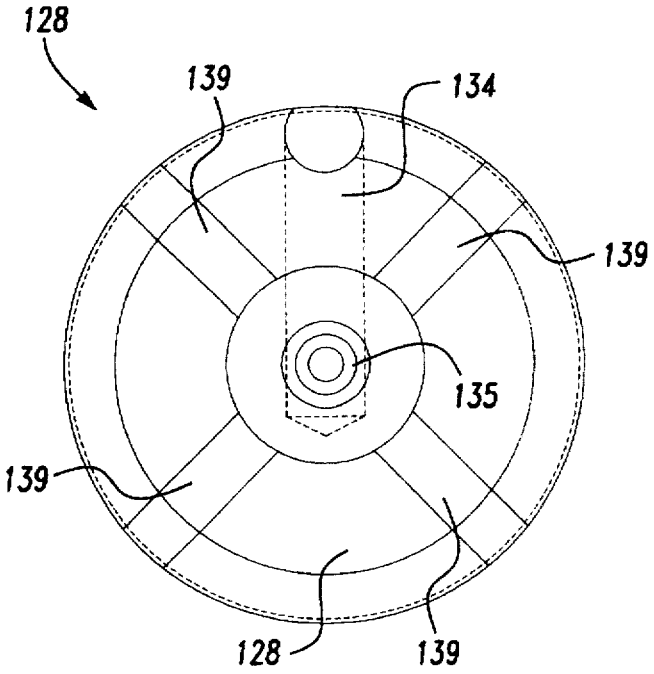
FIG. 9 is a side elevational view of the fuel delivery part of FIG. 8.
Figure 10:
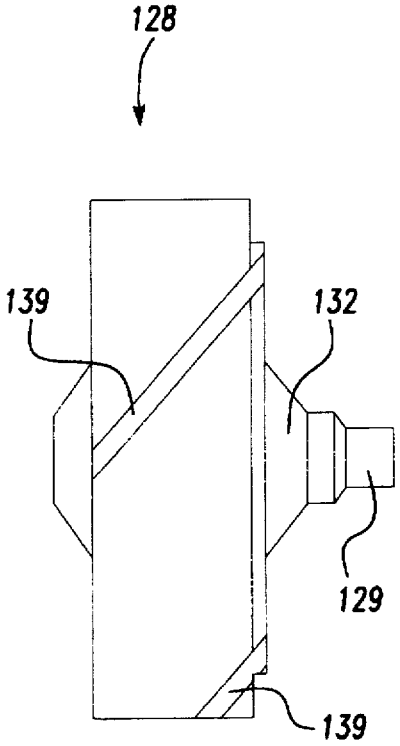
FIG. 10 is a top plan view of the fuel delivery part of FIG. 8.
Figure 11A:
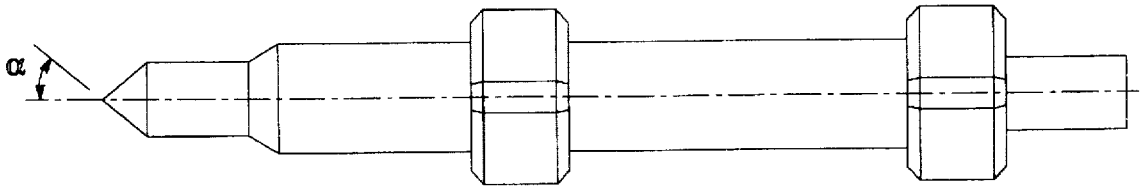
FIG. 11 is a side elevational view of the nozzle valve stem shown in FIG. 3.
Figure 11B:
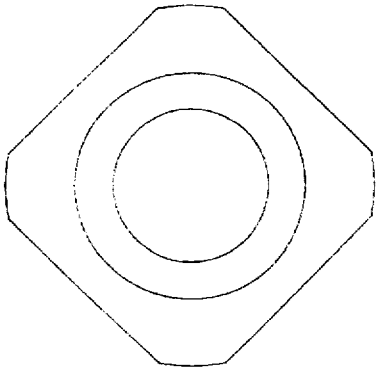
Figure 12:
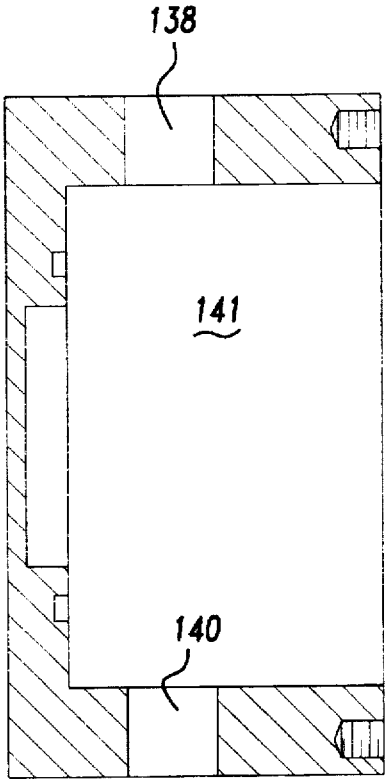
FIG. 12 is a longitudinal sectional view of a back cap part of the apparatus shown in FIG. 3.
Figure 13A:
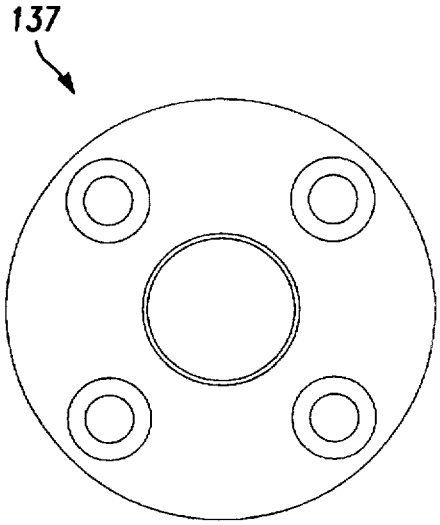
FIG. 13 is a part which forms the back stop for the gas valve stem of the apparatus shown in FIG. 3.
Figure 13B:
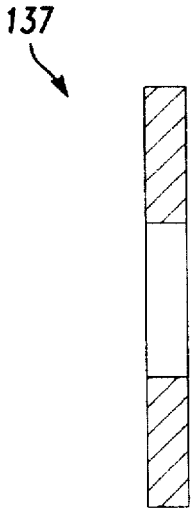
Figure 14:
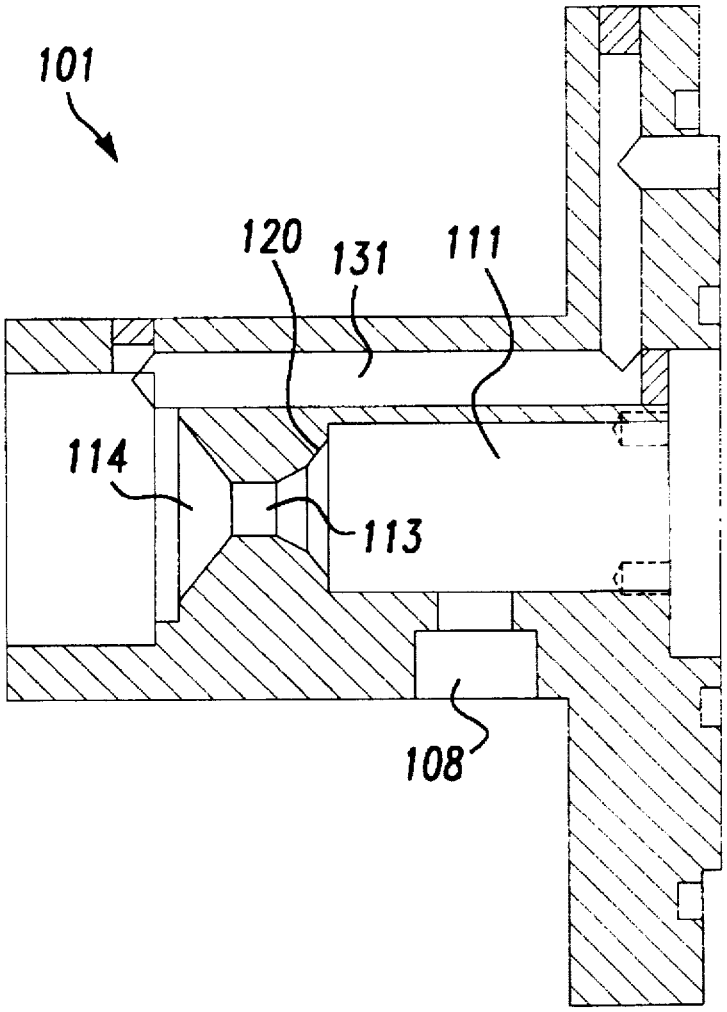
FIG. 14 is a longitudinal sectional view of the main body part of the apparatus shown in FIG. 2.

The first valve member 117 is slidable along the bore 111 between an open position (refer FIG. 3) wherein the valve member 117 is spaced from the converging wall of the bore 111 (ie, which forms the first valve seat 120), thereby allowing gas from the inlet port 108 to pass into the narrow throat area 113, and a closed position (not shown) wherein the valve member 117 bears against the valve seat 120 closing the annular gas flow passage 103.

The first valve stem 116 is biased into the closed position by a first coil spring 121.

The first valve stem 116 itself has a central longitudinally extending bore 122 and slidably receives and guides a second valve stem 123. The second valve stem 123 projects through the first valve member end of the first valve stem 116 so as to be positioned centrally within the narrow throat area 113 to further define the annular flow passage 103. The second valve member 130 is at the distal end of the second valve stem 123 and is made of a resilient plastics material such as Vesconite™. The bore 122 in the first valve stem 116 has an enlarged diameter section 124 spaced inwardly from the first valve member end. The section 124 receives correspondingly enlarged, spaced parts 125 of the second valve stem 123. The enlarged diameter section 124 of the bore 122 in the first valve stem 116 defines a radial end wall 126 which acts as an end stop for the relative sliding movement of the second valve stem 123. As such, the first and second valve stems 116, 123 are generally telescopically arranged.

A fuel delivery part 128 is mounted within the swirl mixing chamber 114 of the bore 111 in the body 101. The delivery part 128 has a second valve seat 129 which combines with the second valve member 130 of the second valve stem 123 to form the fuel delivery nozzle 102.

The delivery part 128 also forms a part of the swirl mixing chamber 114 in that it has a plurality of spiralling gaps 139 extending therethrough.

The fuel delivery part 128 fluidly connects a longitudinally extending fuel delivery bore 131 in the body 101 to the nozzle outlet 109 via a radially extending bore 134 and an axially extending bore 135.

The nozzle outlet 109 is caused to be located within the narrow throat area 113 of the bore 111 in that the fuel delivery part 128 has an axially projecting portion 132, the distal end of which defines the second valve seat 129.

The second valve seat 129 has a concave frusto-conical surface which is concentric with the bore 111. The second valve seat 129 co-operates with the cone shaped second valve member 130 to selectively close the nozzle 102. In the open position of the nozzle 102, the valve seat 129 and valve member 130 define the nozzle outlet 109. The second valve stem 123 is biased by a second coil spring 133 into the closed position.

The first and second valve stems 116, 123 are thereby interconnected such that, when the first and second valve members 117, 130 are in their closed positions, the end stop 126 within the first valve stem 116 is spaced a predetermined distance from the opposing face of the closest one of the enlarged part 125 of the second valve stem 123. As such, the first valve member 117 can be moved away from the first valve seat 120 to open the gas passage 103 without immediately opening the nozzle 102. Once the first valve stem 116 travels the predetermined distance, the opposing face of the enlarged part 125 of the second valve stem 130 comes into abutment with the end stop 126, such that further movement of the first valve stem 116 causes the second valve stem 123 to move with the first valve stem 116 against the bias force of their respective coil springs 121, 133. This movement causes the second valve member 123 to move away from the second valve seat 129 thereby forming the fuel nozzle outlet 109. The degree of opening of the fuel nozzle outlet 109 is limited by another end stop 137 in the bore 111 of the body 101 which prevents further movement of the first valve stem 116. Since it is the first valve stem 116 which moves the second valve stem 130, the second valve stem 130 also stops moving at this point. Further, it will be appreciated that the stroke (ie, movement) of the second valve stem 123 is substantially less than that of the first valve stem 116. For example the stroke of the second valve stem may be about 0.05 mm whereas the first valve stem will move about 0.5 mm.

In their open position, the second valve member 130 and the second valve seat 129 form the nozzle outlet 109 which is an annular passage or channel. The channel is formed between the conical surface of the second valve member 130 and the frusto-conical surface of the second valve seat 130 and, therefore, extends both radially and axially of the longitudinal axis A of the passage 103. That is, the channel extends at an angle $\alpha$ to the longitudinal axis A. The conical sheet of liquid fuel which emanates from the open fuel nozzle outlet 109 is therefore directed at an angle $\alpha$ to the axial direction. The angle $\alpha$ in FIG. 2 is about 35°. As such, the fuel sheet is directed outwards and against the direction of gas flow. It is believed, however, that the angle $\alpha$ may be any angle in the range 5° to 175° with respect to the axial direction (ie, the axis a of the apparatus 100).

More particularly, the present inventor has determined that the most preferred angle $\alpha$ for achieving the shearing atomising effect is about 90°. It will be appreciated that the smaller the angle $\alpha$, the more direct will be the collision between the sheet of fluid and the gas flowing through the passage. This will tend to detract from the "shearing" of liquid droplets from the sheet. Further, if the angle $\alpha$ is large (ie, if $\alpha$ approaches 180°), the liquid sheet will tend to flow with the gas stream and the shearing effect will once again be reduced. As such, the inventor believes that the mixing apparatus 100 will provide the novel "shearing" effect on the sheet of liquid if the angle $\alpha$ is in the range between 5° to 175°. Preferably, the angle $\alpha$ is between 20° and 160° and most preferably in the range 30° to 150°.

When the first valve stem 116 is released, both the first and second valve stems 116, 130 move together by means of the respective spring coils 121, 133 until the second valve member 130 engages the second valve seat 129 to close the fuel nozzle 102. At this point, the gas is still flowing through the annular passage 103. The first valve stem 116, having a longer stroke, continues to slide along the bore 111 until the first valve member 117 engages the first valve seat 120 closing off the gas supply. In this way, the flow of gas from the gas supply is always opened before the fuel is delivered through the nozzle outlet 109 and is shut off only after the fuel outlet nozzle 109 has been closed.

The fuel supply part 128 within the swirl mixing chamber 114 has four spiralling passages 139 which form spiral flow paths. As such, the gas/fuel mixture discharging from the narrow throat area 113 is caused to flow through the spiral flow paths 139 causing it to swirl and mix further. The gas/fuel mixture is then discharged from the apparatus 100 through the outlet 112.

The apparatus 100 shown in FIG. 2 also incorporates a "spill back" circuit including fuel inlet 138 and fuel outlet 140 whereby fuel is continuously pumped into a reservoir 141 within the apparatus 1, 100 and directed back to a remote fuel tank or reservoir via a pressure relief valve (not shown). This arrangement helps to maintain a constant fuel pressure to the nozzle 102 as the nozzle 102 is opened and closed. Further, the increased fuel flow cools the solenoid 142, which is used to actuate the first valve stem 116, is housed in the rear of the apparatus 100, and prevents fuel in and around the reservoir from vaporising or cracking.

Whilst the preferred embodiment is described as having the second valve member 130 made from a resilient plastics material, it will be appreciated that this part could also be made of metal or any other suitable material. In order for a metal valve member 130 and metal valve seat 129 to be most effectively sealed together in the closed position of the nozzle 102, the angle $\alpha$ is preferably about 45° (or 135°). That is, an angle of 45° provides an effective wedging action between the cone-shaped valve member 130 and the concave frusto-conical valve seat 129 if these parts are both made from metal. If the valve member 130 is made of a resilient plastics material such as, for example, Vesconite™ and the valve seat 129 is made from metal, optimal sealing can be achieved with an angle in the range 15° to 75° or 105° to 165°.

During use of the mixing apparatus 100, not all of the fuel leaving the nozzle outlet 109 will be in the liquid sheet. That is, some fuel will tend to stick to the nozzle outlet 109 and run down the outside of the nozzle 102. This mainly occurs at the instant the nozzle 102 opens or closes. To counteract this, the air valving is caused to open before the nozzle 102 and close only after the nozzle 102 closes. This additional gas flow tends to wipe or evaporate any such non-atomised fuel which is on the outside surface of the nozzle 102.

A significant feature of the present invention is that the nozzle is adapted to deliver a substantially continuous, generally radially or conically emanating sheet of liquid. It will be appreciated that the words "generally radially emanating sheet" in the context of the present invention, should be understood to mean a sheet of liquid which is directed so as to have a significant radial component relative to the central longitudinal axis a of the gas passage 3 in FIG. 1 or, 103 in FIGS. 2–16.

These words should not be limited to necessarily mean an outwardly emanating liquid sheet, since it is envisaged that another form of the nozzle (not shown) could direct such a "generally radially emanating sheet" inwards into a central gas passage. That is, the nozzle may be formed around the outside wall of, and to generally surround, the gas passage so as to direct the sheet of liquid generally radially inwards. This sheet of liquid can be directed at any angle within the range of 5° and 175° with respect to the longitudinal axis of the gas passage.

Such an alternative arrangement would still take advantage of the essence of the present invention, that is, a shearing of liquid droplets away from a sheet of liquid. The inventor nevertheless believes that such an alternative arrangement may be less effective than the apparatus 1 of FIG. 1 or, 100 of FIGS. 2–16 shown in the drawings since the shearing action will tend to deflect the atomised liquid droplets back towards the concave outer surface of the passage, whereas the apparatus embodiments shown in the drawings would tend to deflect the atomised droplets back towards to the relatively smaller convex outer surface of the respective nozzles. The larger concave surface would have a greater tendency to catch the atomised liquid droplets which would then collect and drain down the outside surface of the gas passage. Further, the relatively larger circumference of the nozzle would probably cause a proportionally larger amount of liquid to stick to the nozzle outlet rather than be directed with the liquid sheet.

Whilst the wiping action of the additional gas flow before and after the opening of the nozzle should still be able to remove or evaporate most, if not all, of such liquid on the outside surface of the gas passage, it will be appreciated that such an alternative arrangement is likely to work less effectively than the embodiments shown in the drawings.

The apparatus 100 shown in FIG. 2 is specifically adapted for use with internal combustion engines in which it is necessary for the mixing apparatus 100 to supply an air/fuel mixture intermittently to suit the cycle of the engine. The arrangement of the first and second valves allows the apparatus 100 to be opened and closed, either by solenoid actuation (refer FIG. 2) or by mechanical tripping (not shown), to intermittently supply an air/fuel mixture as a generally uniform cloud of atomised liquid fuel droplets of consistent and sufficiently small size.

It will be appreciated that the desired generally uniform cloud of atomised liquid fuel droplets is mainly effected by the fact that the nozzle 2, 102 produces a substantially continuous, radially or conically outwardly emanating sheet of liquid fuel into an annular passage 3, 103, the fuel sheet being atomised by impacting with the gas flowing through the annular passages 3, 103.

The liquid sheet produced by the nozzles 2, 102 is significant in that it contributes to the working of the mixing apparatus 1, 100. That is, the liquid sheet produced by the nozzles 2, 102 utilises the surface tension of the liquid to keep the liquid particles generally together in the sheet until the liquid droplets are caused to shear away from the sheet by the action of the gas flowing through the passages 3, 103.

It is believed that this shearing action forces the liquid droplets away from the thin sheet of liquid to provide a substantially uniform cloud of atomised liquid droplets downstream of the nozzles 2, 102. The shearing action on the sheet of liquid should be contrasted with the prior art arrangements which tend to break up the liquid into droplets before being mixed with the gas.

More particularly, the prior art fuel atomising devices generally rely on the feed pressure of the liquid fuel being forced through one or more outlets to cause the atomisation. The disadvantage of relying on the feed pressure of the liquid fuel is that, in practice, by increasing the fuel feed pressure, the average size of the atomised fuel droplets does not decrease significantly, and even with extremely high pressures there exists a limitation to the minimum average size of the atomised droplets.

In contrast, the present invention utilises the kinetic energy of the gas flowing through the gas passage, rather than the feed pressure of the liquid. The only requirement for the fuel feed pressure in the present apparatus is that it be higher than the pressure of the gas within the gas passage adjacent the nozzles 2, 102, so that the sheet of fuel will be produced from the nozzles 2, 102. Once the sheet of fuel is within the gas passages 3, 103, the gas will impact with the fuel sheet and cause a shearing of the fuel droplets away from the sheet of fuel. This shearing effect will occur at a position intermediate the nozzle outlet and the outside of the passages 3, 103, the actual position being at a point where there is a balance or equilibrium between a number of factors including the velocity of the gas flowing through the passage, the feed pressure of the liquid, the viscosity of the fuel, the thickness of the sheet of fuel, the Reynolds number of the surrounding gas stream, and the like. It is recognised that the balance point is normally closer to the outlets 9, 109 of the respective nozzles 2, 102 and that the gas flowing through the passages 3, 103 which is towards the outside of the passage, may not play a part in the shearing or impact atomisation of the liquid. In the second embodiment shown in FIGS. 2–14, this outer portion of the gas flowing through the passage 103 is nevertheless utilised in the swirl mixing chamber 114 which is downstream of the nozzle 102.

The atomisation of the liquid fuel is enhanced by the reduction in the cross-sectional area of the annular passages 3, 103 in the vicinity of the nozzles 2, 102 which causes increased gas velocity; the fact that the gas flow is created in the annular passage 103 before the fuel nozzle 102 is opened; and the provision of spiralling passages 139 through the fuel supply part 128 downstream of the initial "impact" mixing of the gas and fuel within the narrow throat region 113.

It will also be appreciated that the provision of a substantially continuous 360° radially directed liquid sheet emanating uniformly from the nozzles 12, 102 permits the maximum utilisation of the kinetic energy of the surrounding gas stream to atomise the fuel. It has been found that this produces more consistent atomisation and a smaller average droplet size. The more efficient atomisation also enables higher fuel concentrations and flow rates to be achieved. These factors combine to minimise emissions resulting from unburnt fuel and optimise combustion efficiency. Thus, the invention represents a commercially significant improvement over the prior art.

The invention has particular application to injector nozzles in fuel injection systems. In a particularly preferred application in internal combustion engines, the fuel is atomised prior to injection into the combustion chamber. In this case, rather than being disposed to inject fuel directly into the cylinder, the nozzle is disposed upstream of a conventional inlet duct and valve assembly. The inlet valve of the cylinder can then be linked to the valve arrangement of the injector nozzles 2, 102 such that just before the inlet valve to the combustion chamber opens, the nozzle valve is opened to generate a cloud of atomised fuel in the inlet duct. This air/fuel mixture is then drawn into the combustion chamber in the conventional manner. Preliminary investigations indicate that this significantly enhances performance and combustion efficiency, compared to systems where fuel is injected directly into the combustion chamber.

It should also be appreciated that the entire flow of air required for combustion need not pass through the annular passages 3, 103 surrounding the respective nozzles 2, 102. That is, supplementary air supply ducts or valves may be disposed around or remote from the mixing apparatus 1, 100 in conventional manner, as and when required to suit particular applications. In the automotive application, it is envisaged that the proportion of air flowing through the apparatus 1, 100 would typically be as much as 30%, and as little as 8% or even 5%, of the total volume of air required for combustion, depending on the speed of operation of the engine.

Although the invention has been described with reference to specific examples, it will be appreciated by those skilled in the art that the invention may be embodied in many other forms. In particular, it should be appreciated that the invention is not limited to its application to internal combustion engines. It is applicable in any context requiring a liquid to be atomised in a gas stream. As such, it is also particularly applicable to oil burners, and the like.

Furthermore, it is not necessary in all applications for the nozzle to incorporate valve means to selectively shut-off the liquid supply and/or the gas supply. In applications such as oil burners where a substantially continuous flow is required, the valve construction may be significantly simplified or eliminated altogether. In fuel injection applications a remote metering system may also be used.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A mixing apparatus comprising a nozzle in fluid communication with a source of liquid, and a gas passage immediately adjacent and extending past the nozzle so as to, in use, direct a gas towards and past the nozzle, the nozzle being adapted to direct the liquid in the passage as a substantially continuous, generally radially emanating sheet, such that gas flowing through the passage impacts the liquid sheet to produce a substantially uniform cloud of atomised liquid droplets downstream of the nozzle, the gas passage having a gas valve means upstream of the nozzle, gas valve means is selectively movable between an open and a closed position in coordination with the opening and closing of a plurality of cooperating valve parts of the nozzle such that the nozzle is open only when the gas valve means is also open.

2. The mixing apparatus of claim 1 wherein the passage surrounds the nozzle and the nozzle is adapted to direct the liquid into the surrounding passage as a substantially continuous, generally radially outwardly emanating sheet.

3. The mixing apparatus of claim 2 wherein the passage is substantially coaxial with the nozzle centrally disposed in the passage.

4. The mixing apparatus of claim 3 wherein the nozzle has a peripheral channel extending generally circumferentially around the nozzle which produces the radially emanating fluid sheet and directs the fluid sheet at an angle of between 5° and 175° with respect to the axis of the passage.

5. The mixing apparatus of claim 4 wherein the angle is between 20° and 160°.

6. The mixing apparatus of claim 5 wherein the angle is between 30° and 150°.

7. The mixing apparatus of claim 3 wherein the cross-sectional flow area of the passage is reduced in the vicinity of the nozzle to define a venturi region which increases the velocity of the gas around the nozzle enhancing atomisation of the liquid sheet.

8. The mixing apparatus of claim 7 wherein the venturi region extends a sufficient distance upstream of the nozzle to minimise turbulence of the gas in the passage adjacent to the nozzle.

9. The mixing apparatus of claim 4 wherein the opposing surfaces forming the channel are defined by respective co-operating nozzle valve parts which are selectively movable relative to one another to open and close the channel and allow for intermittent delivery of the radially emanating liquid sheet.

10. The mixing apparatus of claim 9 wherein one of the valve parts forming the nozzle channel is connected to a nozzle valve stem which extends along the axis of the passage and is selectably slidable to move the one valve part relative to another fixed valve part.

11. The mixing apparatus of claim 1 wherein the movable valve parts of the nozzle and the gas valve means are each biased into their closed positions, and are selectively movable away from their closed positions by actuating means.

12. The mixing apparatus of claim 11 wherein the actuating means is in the form of a solenoid or mechanical trip mechanism which acts on a gas valve stem to open the gas valve means against the bias force, the gas valve stem interacting with the nozzle valve stem to open the nozzle channel only after the gas valve means has been opened, and to allow the nozzle channel to close before the gas valve means is allowed to close.

13. The mixing apparatus of claim 12 wherein the nozzle valve stem is telescopically received in and guided by the gas valve stem and has an enlarged part which is acted on by an end stop within the gas valve stem such that, after the valve stem has been moved so as to substantially open the gas valve means, the end stop abuts the enlarged part and the nozzle valve stem is caused to move with the gas valve stem to open the nozzle; and wherein, when the actuating means is caused to release the gas valve stem, both stems start to move under their respective bias forces towards the closed positions of the nozzle valve parts and the gas valve means, the nozzle valve parts moving into their closed position substantially before the gas valve means is closed.

14. The invention as defined in claim 1 in which said nozzle directs said liquid into said passageway as a substantially continuous and generally conical shaped emanating sheet.

* * * * *

UNITED STATES PATENT AND TRADEMARK OFFICE

CERTIFICATE OF CORRECTION

PATENT NO. : 5,735,468

DATED : April 7, 1998

INVENTOR(S) : Alan Patrick Casey

It is certified that error appears in the above-identified patent and that said Letters Patent are hereby corrected as shown below:

Column 1, line 4, Delete "presentation" and insert -- present--.
Column 2, line 9, Delete "prederably" and insert --preferably--.
Column 2, line 29, Delete "usinig" and insert -- using--.
Column 2, line 30, Delete "onventional" and insert -- conventional--.
Column 5, line 60, Delete "a" and insert --A--.
Column 7, line 3, Delete "a" and insert --A--.
Column 7, line 52, Delete "nozzle" and insert --nozzles--.
Column 10, line 5, After the word "channel" insert -- opening into the passageway and--.
Column 10, line 6, After the word "nozzle" insert --, the channel being formed by opposing surfaces which extend generally radially a sufficient distance so as to--.
Column 10, line 6, Delete the word "which".
Column 10, line 6, Delete "produces" and insert --produce--.
Column 10, line 7, Delete "fluid" (both occurrences) and insert --liquid-- (both occurrences).
Column 10, line 7, Delete "directs" and insert -- direct--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*